US007090561B2

(12) United States Patent
Cambridge et al.

(10) Patent No.: US 7,090,561 B2
(45) Date of Patent: Aug. 15, 2006

(54) METHOD AND APPARATUS FOR PIVOT POINT DETERMINATION AND MACHINE TOOL ADJUSTMENT

(75) Inventors: Richard William Cambridge, West Chester, OH (US); James Edward Randolph, Jr., Mason, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 11/005,986

(22) Filed: Dec. 7, 2004

(65) Prior Publication Data

US 2006/0121828 A1 Jun. 8, 2006

(51) Int. Cl.
*B24B 49/00* (2006.01)

(52) U.S. Cl. ..... 451/5; 451/11; 451/8

(58) Field of Classification Search ..... 451/5, 451/8–12

See application file for complete search history.

(56) References Cited

U.S. PATENT DOCUMENTS

| | | | | |
|---|---|---|---|---|
| 4,078,195 | A | 3/1978 | Mathias et al. | |
| 4,998,383 | A | 3/1991 | Waelti | |
| 5,021,941 | A | 6/1991 | Ford et al. | |
| 5,309,646 | A * | 5/1994 | Randolph, Jr. et al. | 33/502 |
| 5,329,457 | A * | 7/1994 | Hemmerle et al. | 700/193 |
| 5,357,450 | A * | 10/1994 | Hemmerle et al. | 700/176 |
| 5,374,883 | A | 12/1994 | Morser | |
| 5,730,643 | A | 3/1998 | Bartlett et al. | |
| 5,834,623 | A * | 11/1998 | Ignagni | 702/105 |
| 6,427,098 | B1 * | 7/2002 | Alverson et al. | 700/245 |
| 6,519,860 | B1 | 2/2003 | Bieg et al. | |
| 6,615,102 | B1 | 9/2003 | Morfino | |
| 6,640,607 | B1 | 11/2003 | Abbe | |
| 6,721,675 | B1 | 4/2004 | Chawla | |
| 6,859,747 | B1 | 2/2005 | Yutkowitz | |
| 2001/0018312 | A1 * | 8/2001 | Gottschalk | 451/5 |
| 2002/0087233 | A1 | 7/2002 | Raab | |
| 2003/0014498 | A1 | 1/2003 | Kreidler et al. | |
| 2003/0036868 | A1 | 2/2003 | Yutkowitz | |
| 2003/0056147 | A1 | 3/2003 | Yutkowitz | |
| 2003/0105603 | A1 | 6/2003 | Hardesty | |
| 2004/0050139 | A1 | 3/2004 | Comer et al. | |
| 2005/0107000 | A1 * | 5/2005 | Otsuki et al. | 451/5 |

FOREIGN PATENT DOCUMENTS

WO WO 2004/033147 A2 4/2004

* cited by examiner

*Primary Examiner*—Dung Van Nguyen
(74) *Attorney, Agent, or Firm*—William Scott Andes; Armstrong Teasdale LLP

(57) ABSTRACT

A CNC apparatus has a memory configured to compensate for offsets in a pivot point. The machine tool has a head, a pivot point, a spindle, a table, and at least four axes including an X-axis, a Y-axis, a Z-axis, and a C-axis. A method for calibrating the CNC apparatus for controlling the machine tool includes placing an artifact of known height on the table, placing a plug having a known diameter on the spindle and touching the plug to the artifact in a plurality of orientations of the plug and in a plurality of locations of the plug and the artifact to determine uncalibrated X and Y pivot point locations at a plurality of orientations of the spindle. The uncalibrated X and Y pivot point locations are used to determine and store values in the memory of the CNC apparatus to compensate for offsets in the pivot point.

20 Claims, 5 Drawing Sheets

METHOD AND APPARATUS FOR PIVOT POINT DETERMINATION AND MACHINE TOOL ADJUSTMENT

BACKGROUND OF THE INVENTION

This invention relates generally to the use and control of grinding machines for producing machined parts.

It has been observed that the pivot point location of grinder machine tool heads can vary when maintenance is performed on a machine spindle. The pivot point is offset from the spindle centerline. This offset is unknown and can cause all part programs for a particular machine to become obsolete as the relationship between the pivot point and the machine home position is different. As a result, each grinding program has to be re-programmed. In addition, programs cannot be transferred to other machines, since the offset variation between machines is also different and unknown.

In at least one known system, any change in the spindle offset or movement of a program to a different machine requires a programmer to manually place a machine in a position of each of the operations needed to simulate a production cut. The five axis coordinates of the machine's grinding are then manually recorded and adjustments are manually made to a program to compensate for the new relationship between the pivot point of the spindle and the home position of the grinding machine. The need for such adjustments makes it difficult or impossible to use computer numerical control (CNC) programs for grinding a part on other grinders within a shop having a plurality of grinders without personal attention being given to adjusting the program on each of the grinders.

BRIEF DESCRIPTION OF THE INVENTION

Thus, some configurations of the present invention provide a method for calibrating a CNC apparatus for controlling a machine tool. The CNC apparatus has a memory configured to compensate for offsets in a pivot point. The machine tool has a head, a pivot point, a spindle, a table, and at least four axes including an X-axis, a Y-axis, a Z-axis, and a C-axis. The method includes placing an artifact of known height on the table, placing a plug having a known diameter on the spindle and touching the plug to the artifact in a plurality of orientations of the plug and in a plurality of locations of the plug and the artifact to determine uncalibrated X and Y pivot point locations at a plurality of orientations of the spindle. The method utilizes the uncalibrated X and Y pivot point locations to determine and store values in the memory of the CNC apparatus to compensate for offsets in the pivot point.

Some configurations of the present invention provide a computer-readable medium having recorded thereon machine readable instructions. The instructions are configured to instruct a computer to prompt a user to manually input uncalibrated X and Y pivot point locations at a plurality of orientations of a spindle of a computer numerically controlled (CNC) machine tool having a head, a pivot point, a spindle, a table, and at least four axes including an X-axis, a Y-axis, a Z-axis, and a C-axis. Also, the instructions are configured to instruct the computer to utilize the uncalibrated X and Y pivot point locations to determine and display values of compensation data for entry in a memory of a CNC apparatus, wherein the compensation data is determined to compensate for offsets in a pivot point of the machine tool.

Also, some configurations of the present invention provide a computer numerical control (CNC) apparatus for a machine tool having a head, a pivot point, a spindle, a table, and at least four axes including an X-axis, a Y-axis, a Z-axis, and a C-axis. The CNC apparatus is configured to prompt a user to place a plug on a spindle of the machine tool and an artifact on a table, and to prompt a user to orient the plug in a plurality of orientations and to touch the plug to the artifact in a plurality of locations. The CNC apparatus is further configured to determine a plurality of uncalibrated X and Y pivot point locations from during the touching, and to utilize the uncalibrated X and Y pivot point locations to determine and display values of compensation data to enter values in a memory of the CNC apparatus, wherein the compensation data is determined to compensate for offsets in a pivot point of the machine tool.

It will thus be appreciated that configurations of the present invention facilitate the use of a single program on a plurality of like machine tools that may be in use in a machine shop to produce identically shaped and dimensioned parts.

DETAILED DESCRIPTION OF THE INVENTION

Figure 1:
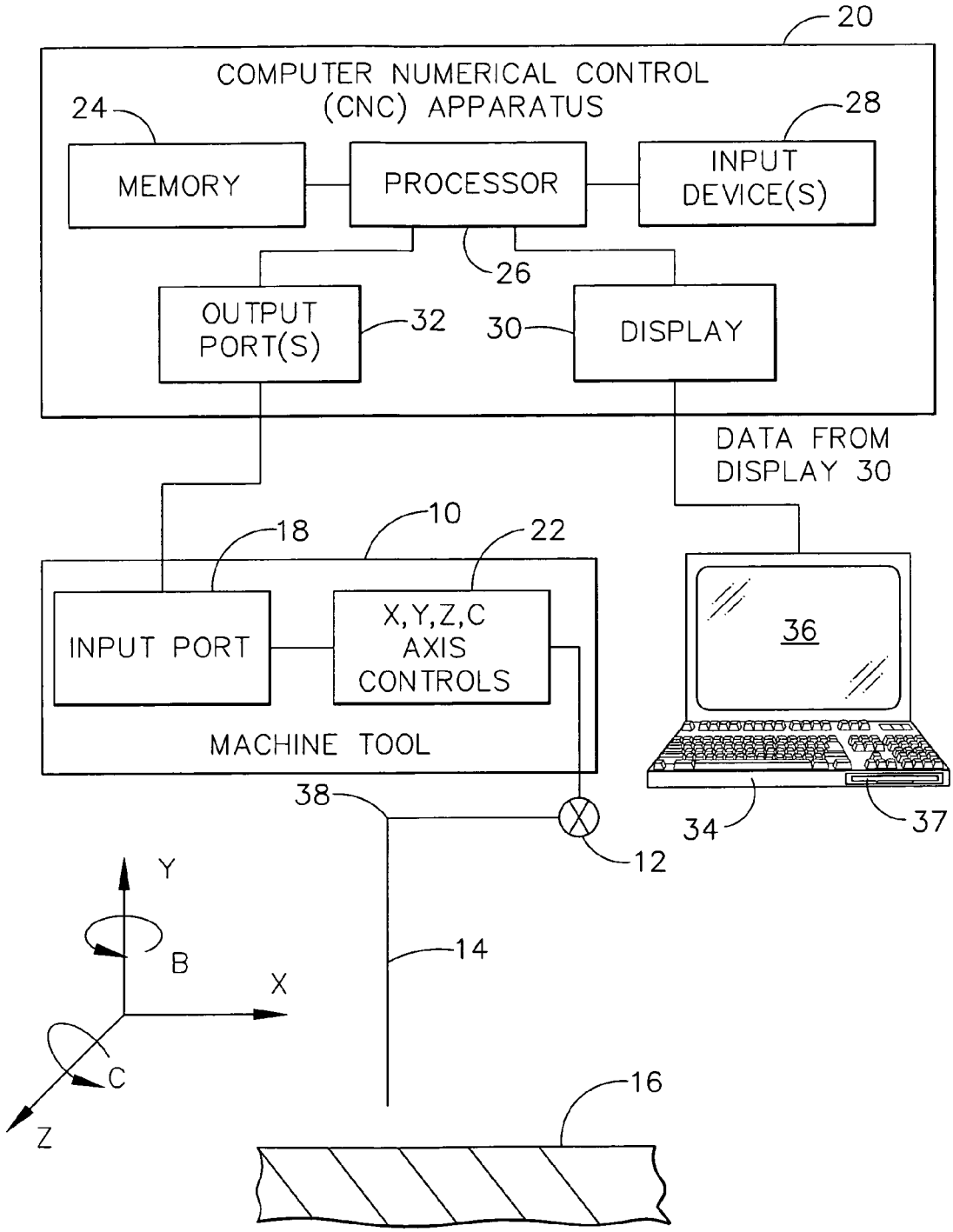
FIG. 1 is a schematic representation of a portion of a machine shop showing a machine tool, a computer numerical control (CNC) apparatus that controls the machine tool, and a computer that is used in some configurations of the present invention to determine offset values to be transferred to registers of the CNC apparatus.

In some configurations, technical effects of the present invention include the calibration of offsets of certain machine tools used in conjunction with computer numerical control (CNC) apparatus. Referring to the schematic representation of FIG. 1, some machine shops for producing parts under computer numerical control (CNC) includes one or more machine tools 10 such as a grinding machine. Machine tool 10 includes a head (not explicitly shown in FIG. 1, but which can be considered as being schematically represented as part of box 10), a pivot point 12, a spindle 14, a table 16, and at least four axes including an X-axis, a Y-axis, a Z-axis, and a C-axis. X, Y, and Z are spatial directions, whereas B and C are rotational directions, with B rotated about Y and C rotated about Z. The C-axis represents rotation around elbow 38. Use of a B-axis is not required to practice various configurations of the present invention. Machine tool 10 is configured for computer numerical control. For example, in some configurations, machine tool 10 comprises an input port 18 to accept commands from a computer numerical control apparatus 20. These commands are interpreted by a controller or controllers 22 for (at least) the X-, Y-, Z-, and C-axes to operate a tool mounted on spindle 14, such as a grinding head (not shown in FIG. 1). The grinding head grinds a component on table 16.

Computer numerical control apparatus 20 includes a memory 24. Memory 24 is also used to store one or more CNC programs for grinding or machining the part on table 16 as well as a memory that is used to store values that compensate for pivot point 12 offsets. CNC apparatus 20 also includes a processor 26 used to interpret instructions stored in memory 24 and received via an input device or devices 28 in some configurations. Input device(s) may include a keyboard, keypad and/or mouse for human input and/or a media reading device, such as a floppy disk drive, a CD-ROM drive, a DVD-ROM drive, or a network port. These and many input devices 28 and memory devices 24 are known in the art, so that a selection of one or more types of each and their electrical configurations can be left as a design choice by one of ordinary skill in the art of computer design. CNC 20 in some configurations also includes a display 30, such as an LCD or CRT display (a printer is also suitable in many configurations), and an output port 32 that communicates commands to input port 18 of machine tool 10. The present invention does not require CNC 20 and machine tool 10 to be physically separate from one another. Thus, the functions of both CNC 20 and machine tool 10 may be present in one unit, and in one such configuration, output port(s) 32 and input port 18 are replaced by a direct electrical connection between processor 26 and axis controls 22. Also, in various configurations, one or more of output port(s) 32 and/or some or all of memory 24 may be incorporated on a single chip or circuit board with processor 26.

In some configurations of the present invention, values displayed on display 30 of CNC 20 are input to a computer 34 having its own display 36 and running a spreadsheet described below. The spreadsheet program is supplied on one or more machine readable media (not shown in FIG. 1, but which may be read by a suitable device, for example, a floppy disk drive 37 in the case of a floppy disk). For present purposes, "a machine readable medium having instructions recorded thereon" is intended to include such media as floppy disks, CD-ROMs, CD-Rs, CD-RWs, DVD-ROMs, DVD-R, DVD-RW, DVD+R, DVD+RW, computer hard drives on a network, USB flash memory devices, etc., that can be read by a computer using any of the various known input devices, adapters, etc. Furthermore, the term "a machine readable medium having instructions recorded thereon" is also intended to encompass programs spanning a plurality of instances of a single medium (e.g., two or more floppy diskettes) or media (e.g., one or more floppy diskettes and one or more CD-ROM(s)), simply because a computer program can be too large to fit on a single instance of a medium or simply divided arbitrarily or as a design choice between one or more instances of a medium or a plurality of media.

Figure 3:
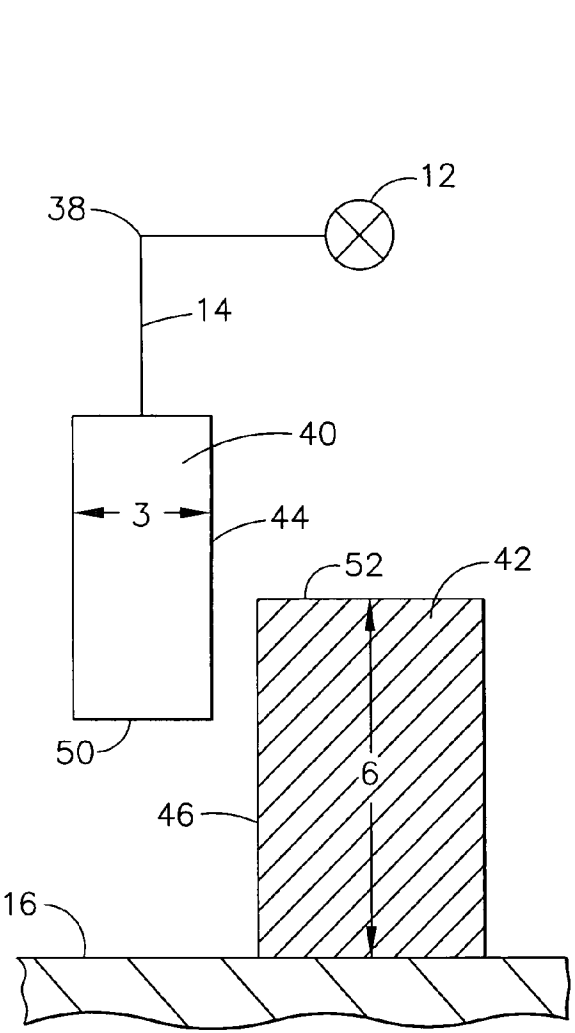
FIG. 3 is a representation of a plug and an artifact used in some configurations of the present invention to calibrate the CNC apparatus of FIG. 1 to compensate for the unknown offsets. The plug is represented on a spindle of the machine tool, and is shown not touching the artifact.
Figure 2:
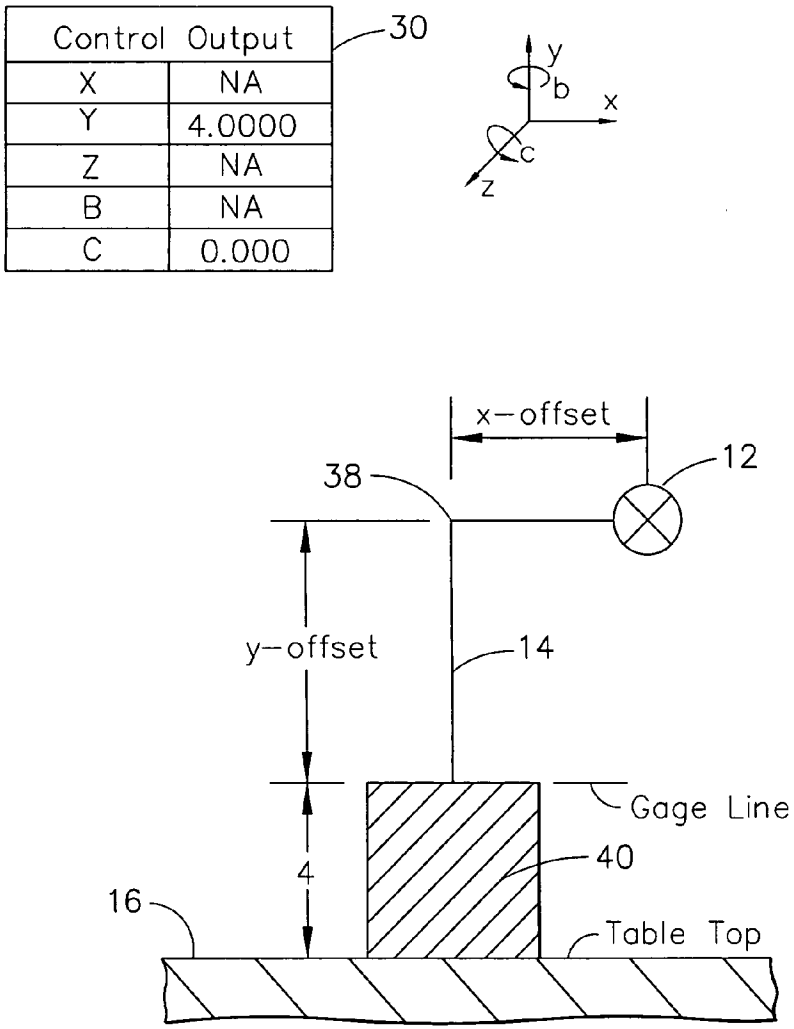
FIG. 2 is a representation of a position of the machine tool shown in FIG. 1, wherein unknown offset dimensions are defined and shown and a CNC output display representing the position of the machine tool is also shown.

In some configurations and referring to FIGS. 2 and 3, the x-offset and the y-offset of pivot point 12 of spindle 14 are determined and compensated by a user or technician. These offsets are determined using a procedure in which the user or technician places spindle 14 in four positions relative to an artifact 42 (shown in FIG. 2) having known dimensions. A these offsets are determined in some configurations by using a spreadsheet program that is run by computer 34 shown in FIG. 1.

In some configurations and referring to the sequence of FIGS. 4–7, a grinding machine 10 (shown in FIG. 1, but omitted from FIGS. 4–7) has 5 axes and a table 16, wherein table 16 and three axes X, Y, and Z are moveable as a result of the head of grinding machine 10 being able to rotate and pivot. The head rotates around pivot point 12. For some machine tools 10, the head is not pinned to the rest of the machine tool 10 body. Thus, when the head is taken off and replaced on tool 10, such as for maintenance, the head is not always perfectly located. When tools 10 come from the factory, the location of pivot point 12 for each machine tool 10 is typically in a different location. Therefore, even though a plant may have a plurality of otherwise identical machines 10, pivot points 12 are in a different location in each machine tool 10.

In some configurations, a cylindrical plug 40 is attached on spindle 14 at the end of elbow 38, which itself is a 90 degree elbow. Plug 40 is cylindrical to ensure that wherever it is touched along its edge 42, the distance from the touched point to spindle 14 is the same. A noncylindrical plug could be used, although measurements of the distance from touching points along its edge and spindle 14 would have to be made and adjustments would have to be made in the equations disclosed below to take these distances into account. As spindle 14 is rotated in the C direction about pivot point 12, the precise location of plug 40 is not known to CNC 20 because the X and Y offsets of pivot point 12 (as shown in FIG. 2) are not known. Thus, it is also not known where plug 40 actually moves when it rotates. To machine parts to a blueprint, the X and Y offsets either have to be known or compensated for so that a control program in CNC 20 can move the head of machine tool 10 to the proper positions and angles specified by a numerical control program.

To find the center or pivot point 12, a plug 40 (which can be, but need not be a tool, such as a grinding wheel or cutter) of a known diameter is placed on spindle 14, as shown in FIG. 3. An artifact 42 of known height is placed on table 16. The diameter of plug 40 and the height of artifact 42 are not critical, but must be known or measured. In the present example, the diameter of plug 40 is 3 and the height of artifact 42 is 6. Because the actual dimensions are not critical, it does not matter whether the units of these dimensions are English or metric as long as the units are used consistently. (For purposes of the examples described herein, it will be assumed that English units of inches are used throughout.) The artifact can be any object with perpendicular sides, such as an angle plate purchased from a manufacturer.

Figure 4:
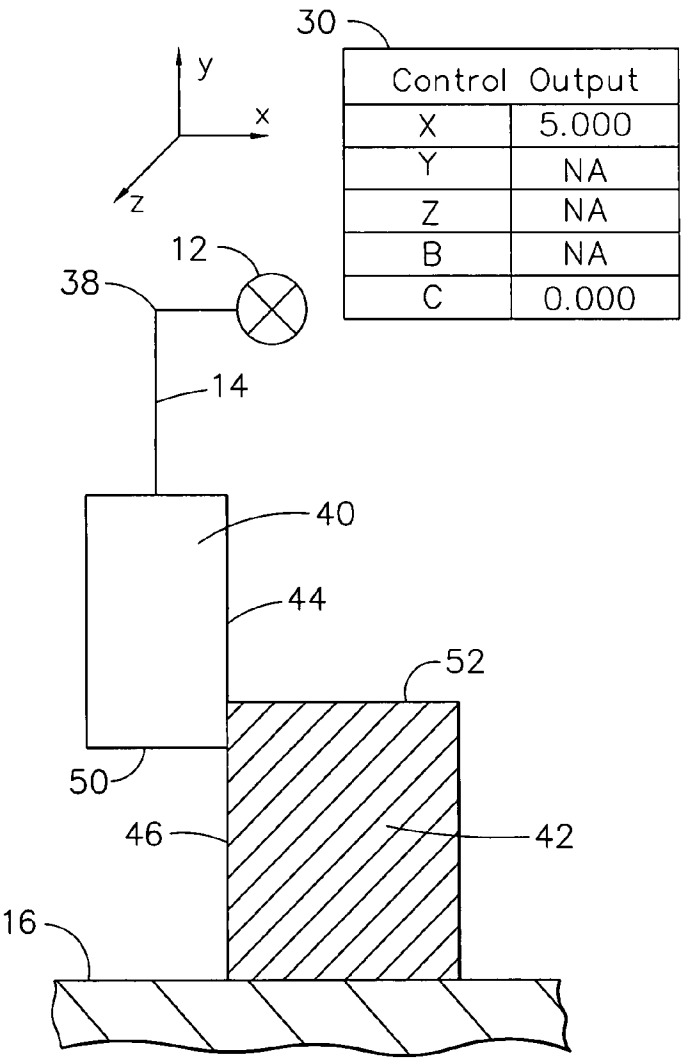
FIG. 4 is a representation of a step performed in some configurations of the present invention wherein a side of the unrotated plug touches a side of the artifact, and an uncalibrated X-offset value is read from the CNC output display.

In some configurations and referring to FIG. 4, to calibrate CNC 20 to compensate for offsets to pivot point 12, a side 44 of plug 40 is touched to a side 46 of artifact 42. Display 30 of CNC 20 (which has not yet been calibrated) displays an X value relative to the (uncalibrated) origin or zero position of pivot point 12, where the x-offset and y-offset are illustrated in FIG. 2. The C-axis angle is zero for this measurement, i.e., no rotation in the C-direction has been applied. FIG. 4 illustrates a case in which the uncalibrated X offset value is measured happens to be 5.0000. (In a typical case, it should not be assumed that the value would be an exact integer to four decimal places.) (Values that might be shown in CNC 20 display 30 but which are not relevant for a calibration step are shown as NA in the Figures).

Figure 5:
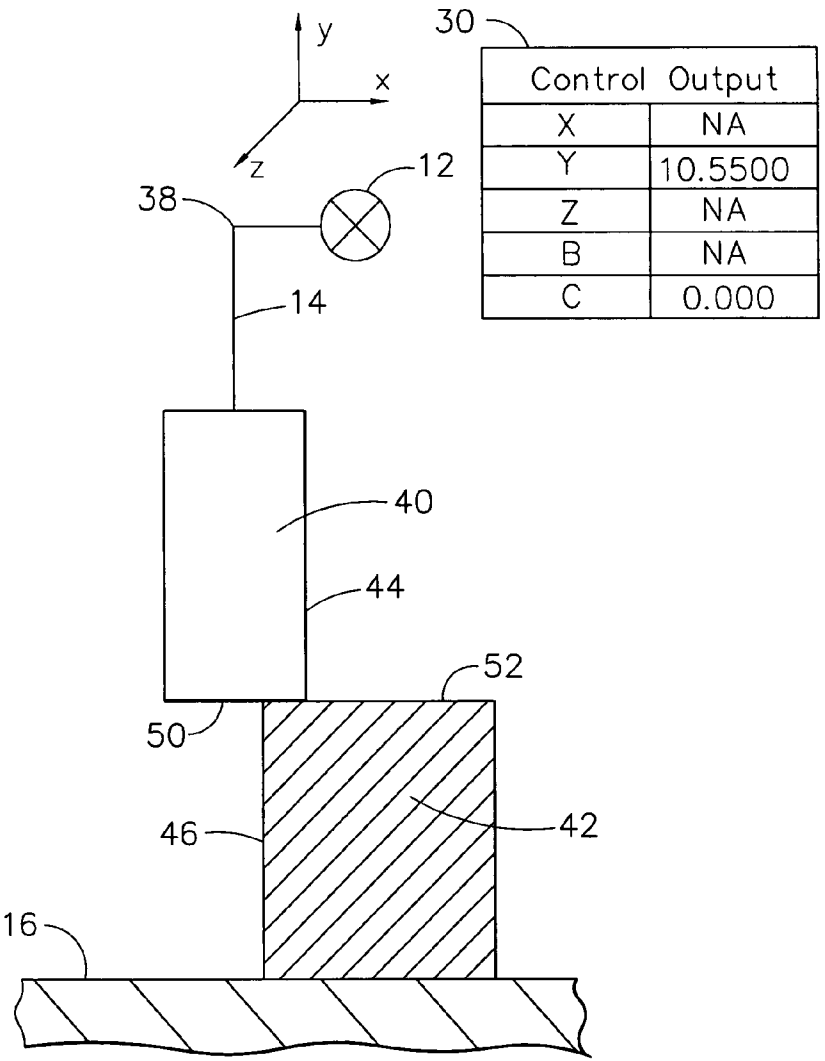
FIG. 5 is a representation of another step performed in some configurations of the present invention wherein a bottom of the unrotated plug touches the top of the artifact, and an uncalibrated Y-offset value is read from the CNC output display.

Referring to FIG. 5, the machine user or technician then moves plug 40 to touch the bottom or end 50 of plug 40 to the top 52 of artifact 42, and the value of Y is read from CNC 20 display 30. In this example, the value of Y is 10.5500. For this step, the value of X is immaterial, but C remains at 0.

Figure 6:
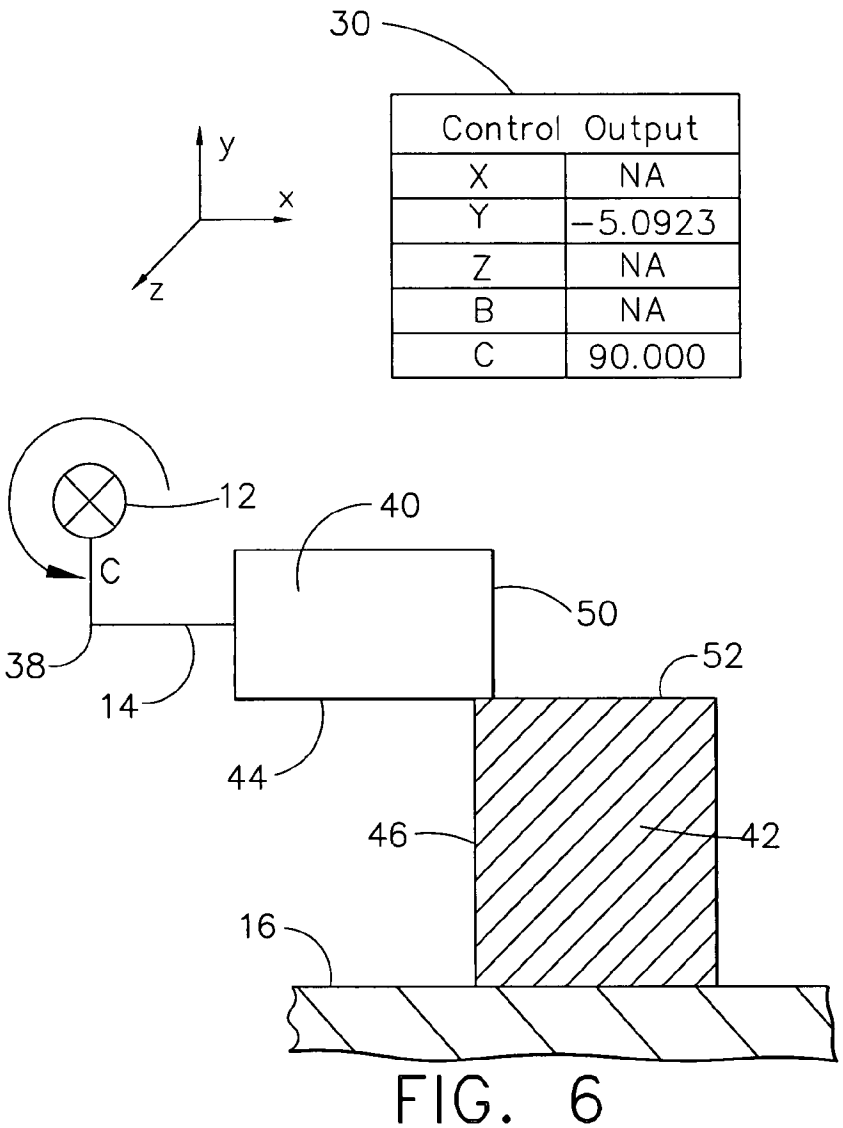
FIG. 6 is a representation of another step performed in some configurations of the present invention wherein the side of the plug rotated 90 degrees is touched to the top of the artifact, and an uncalibrated Y-offset value is read from the CNC output display.

Next, and referring to FIG. 6, elbow 38 of spindle 14 is pivoted in the C-direction by 90 degrees, so that plug 40 is at a 90 degree angle relative to table 16, and side 44 of plug 40 is touched to top 52 of artifact 42. The value for Y is then read from display 30, which, in the case of the example, is −5.0923. In this step, the values of X, Z, and B are immaterial. Note that the Y value changes because pivot point 12 has moved closer to table 16 as a result of the rotation.

Figure 7:
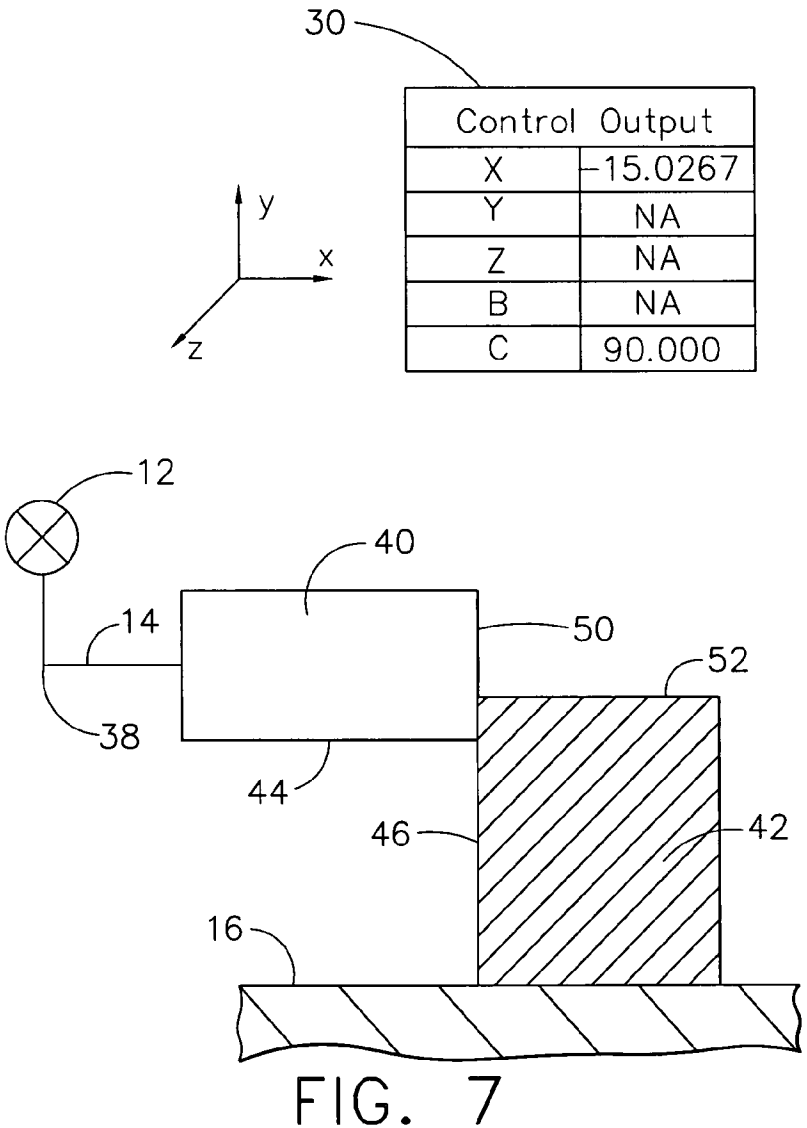
FIG. 7 is a representation of another step performed in some configurations of the present invention wherein the bottom of the plug rotated 90 is touched to the side of the artifact, and an uncalibrated X-offset value is read from the CNC output display.

Next, and referring to FIG. 7, end 50 of plug 40 is touched against side 46 of artifact 42, and the value of X is read. In this example, the value of X is −15.0267. The value of C is still 90 degrees, as elbow 38 of spindle 14 has not been rotated from the position in FIG. 6. The values of the other variables are immaterial for this step.

Artifact 42 remains stationary in all of the steps shown in FIGS. 3–7. In some configurations, artifact 42 is held in place on table 16 by magnetic force. For example, a magnetized artifact 42 may be used in conjunction with a magnetic base or table 16 to ensure that artifact 42 does not move during the calibration process.

In some configurations, a technical effect of the present invention is achieved, in part, by a user or technician entering data into cells of a spreadsheet and transferring results to CNC apparatus 20. Thus, in some configurations and referring to FIGS. 1 and 8, a pivot point calculator (for example, a spreadsheet program) is run by computer 34 and used to determine offsets for control registers (e.g., particular locations in portion of memory 24) in a CNC program used in CNC apparatus 20 to control machine tool 10. The pivot point calculator program, in some configurations, is a spreadsheet worksheet that includes instructions to produce an output on computer display 36 similar to that shown in FIG. 8. Some configurations are provided with default dimensions 53, 54 of artifact 42 and plug or calibration block 40, respectively, which can be hard-coded into the instructions in some configurations. However, in many configurations, default dimensions 53 and/or 54 may be changed by an entry made by the technician into the spreadsheet the calibration procedure is performed using artifacts 42 and/or plugs 40 other than those having the default dimensions.

Figure 8:
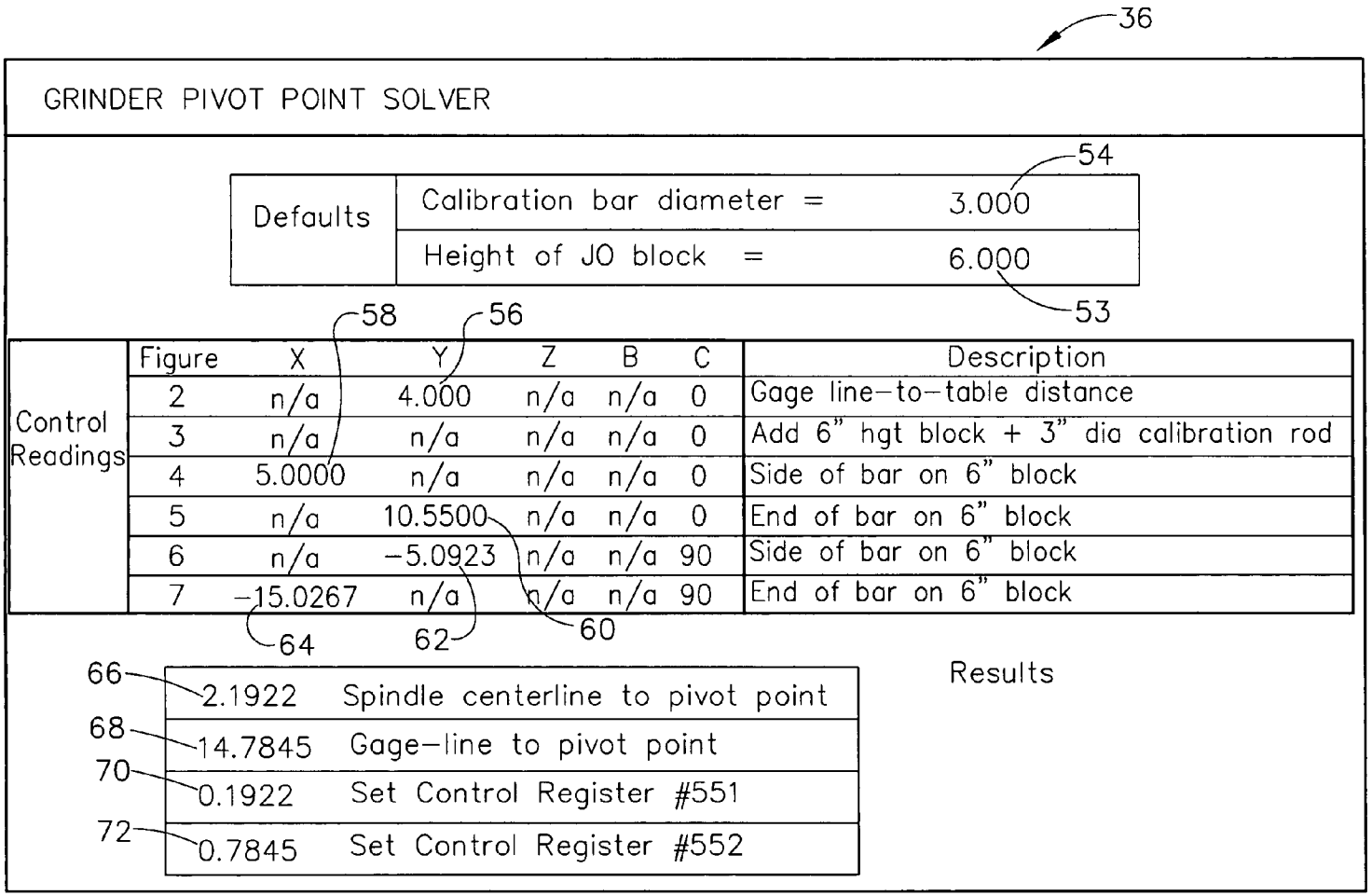
FIG. 8 is a representation of a spreadsheet program display wherein the offsets read in FIGS. 4–7 have been entered. The spreadsheet calculates the values to be placed in control registers of the CNC apparatus of FIG. 1, and these values are transferred to this apparatus in some configurations of the present invention.

The spreadsheet display shown in FIG. 8 displays English units, but metric or other units can be used for dimensions as long as they are used consistently or at least interpreted consistently by the formulas in the worksheet. Moreover, it is not necessary to use the dimensions of plug 40 and artifact 42 shown in this example, provided the actual dimensions are known (either beforehand or measured during or after calibration) and used.

Areas of the spreadsheet such as cells 53, 54, 56, 58, 60, 62 and 64 are highlighed (such as by utilizing a background color) in some configurations to indicate where a user or technician is to enter numbers. The values entered in cells 56, 58, 60, 62, and 64 in FIG. 8 are those read from read CNC 20 display screen 30 at the steps of the procedure described for that line. These values can be entered as the steps are performed if it is convenient to do so. Calibration results are determined and provided by computer 34 in accordance with the instructions of the spreadsheet program. In this example, 2.1922 units (the units are inches in this example, but could be metric or other units, instead) is determined as spindle 14 centerline to pivot point 12 offset and is displayed at 66. This offset corresponds to the unknown X-offset shown in FIG. 2, in the same units as used for the offsets indicated on display 30. Also, the Y-offset shown in FIG. 2, (a gage line to pivot point offset) is determined in this example to be 14.7845 units and is displayed at 68. The actual offsets determined in any particular case will vary, but are not functions of the sizes of either artifact 42 or plug 40. These offsets numbers are used by the worksheet instructions to determine control register settings 70 and 72 that are entered manually or automatically (e.g., entered using an input device 28 to CNC 20) to a register or registers in memory 24 and used by processor 26 to compensate for these offsets. The manufacturer of CNC 20 provides a formula or an algorithm to determine these values from determined spindle centerline to pivot point and gage line to pivot point offsets. In the present example, the registers to be set happen to be designated as control registers #551 and #552, but these designations will vary depending upon the CNC apparatus 20 used. These registers are sometimes referred to as "dynamic offset registers," because the values entered in these registers enable one to place the end of a tool on spindle 14 in the same place every time, even though the length of the offset dimensions shown in FIG. 2 have changed. In the present example, the values shown in cells 70 and 72 that are to be set are merely the differences between the determined results in cells 66 and 68 and the nominal default values 2.0000 and 14.0000, respectively. (The default values may depend upon the particular type or model machine tool 10 and CNC apparatus 20 being used.) In other configurations, the values to be set may be determined differently.

It is not actually required that a spindle centerline to pivot point and/or a gage-line to pivot point distance be displayed as part of the spreadsheet. However, but it is helpful for configurations of the present invention to do so to facilitate discovery of data entry or other procedural errors.

The functions used to determine the spindle centerline to pivot point dimension and the gage line to pivot point dimension in some configurations of the present invention are:

$$SCLPP=((X2-X5+(BD/2))-(Y3-Y4+(BD/2)))/2$$

$$GLPP=((X2-X5+(BD/2))+(Y3-Y4+(BD/2)))/2-(Y3-JBH),$$

where:

SCLPP=spindle centerline to pivot point dimension;

BD=a diameter of the plug on the spindle;

X2=the value of X offset read from the control output (e.g., CNC 20 display 30) when touching a side 44 of unrotated plug 40 to a side 46 of artifact 42;

X5=the value of X offset read from the control output when touching a bottom 50 of plug 40 rotated 90 degrees to side 46 of artifact 42;

Y3=the value of Y offset read from the control output when touching the bottom 50 of unrotated plug 40 to the top 52 of artifact 42;

Y4=the value of Y offset read from the control output when touching the side 44 of plug 40 rotated 90 degrees to the top 52 of artifact 42;

GLPP=the gage line to pivot point dimension; and

JBH=JO block height (i.e., the height of artifact 42).

(The numbering used in the notation X2, X5, Y3, and Y4 does not match the sequential numbers in the first column of the control readings block in FIG. 8. The numbering is not intended to have any special significance, but happens to correspond to a sequence of numbered instructions provided to a CNC apparatus operator. In the present example, the numbers in the first column of the control readings block in FIG. 8 match the Figure numbering in the present description. In the present example, the values of X2, X5, Y3, and Y4 are given by the numbers denoted by reference numerals 58, 64, 60, and 62, respectively. The value of BD is the number denoted by reference numeral 54, and the value of JBH is the number denoted by reference numeral 53 in the present example. Also, the resulting values of SCLPP and GLPP are denoted by reference numerals 66 and 68, respectively.)

The order in which the are steps performed to obtain control outputs X2, X5, Y3, and Y4 is not necessarily the order implied by the numbers used with the control output variables, as long as all of these variables are obtained. However, in some cases it may be faster and more efficient to perform the steps in the order described herein because only one rotation step is required for performing the steps in this order. Additionally, some commonality exists between the equations from which SCLPP and GLPP are determined. Thus, computational efficiencies may be achieved in some configurations by determining (X2−X5+(BD/2)) and (Y3−Y4+(BD/2)) first, for example, and using these results in the calculations for SCLPP and GLPP rather than performing the calculations for SCLPP and GLPP directly as indicated in the equations. One of ordinary skill in the art will be able to achieve efficiencies such as this upon developing an understanding of the present invention.

Configurations of the present invention are not dependent upon any particular height of artifact 42 or any particular diameter of plug 40, as long as they are known and do not change during the procedure. Thus, the dimensions of both plug 40 and artifact 42 may be selected for the convenience of the user or technician. In some configurations, plug 40 and artifact 42 dimensions are preselected. By preselecting these dimensions, and by providing a plug 40 and an artifact 42 in accordance with these dimensions, the values of these dimensions can be hard-coded into the spreadsheet or other offset calculation program. This hardcoding relieves the user or technician from having to measure and/or enter these dimensions each time the procedure is repeated for any given machine tool 10 or any set of machine tools.

Configurations of the present invention can be used not only with grinding machines as machine tools 10, but for any other type of computer numeric controlled equipment in which a spindle is offset from a pivot point, such as some milling machines.

Configurations of the present invention are generally applicable to machine tools that utilize CNC (computer numeric control) apparatus 20, and that have at least four axes (namely, X, Y, Z, and C axes). The presence of a B axis is not required to practice the present invention, nor does it affect the location of the pivot point.

In some configurations, the spreadsheet file ("worksheet") or other program for calculating offset-compensating control register values is provided in machine readable form (such as on one or more floppy diskettes, CD-ROMs, CD-RWs, DVDs, or other medium or any combination of media, including electronic signals communicated via a wired or wireless network). The worksheet is read by a computer running a spreadsheet program such as Microsoft Excel, although the selection of a particular spreadsheet program (or to implement the pivot point program differently, for example, as a standalone, separately executable program) can be left as a design choice to one of ordinary skill in the art. In some configurations, results 70, 72 are transferred to CNC apparatus 20 manually in some configurations, but in other configurations, the results are automatically transferred via a network or other communications channel (not shown in the Figures).

As noted above, some configurations of the present invention utilize a stand-alone program provided in machine readable form. Also, some configurations of the present invention do not require a computer having a separate operating system, but either contain instructions for booting and running the program directly without the benefit of an operating system or are executed on a special-purpose computer. For example, in some configurations, the computing device is a special purpose device in which the machine readable medium is a read-only memory (or programmable read-only memory) containing instructions for the computing device to accept the control outputs obtained by the technical and determine and display the offset values and/or register values to the technician or communicate them directly to CNC apparatus 20. In still other configurations, the instructions are provided in a memory 24 of CNC apparatus 20 itself, executed in a processor 26 of CNC apparatus 20, and the control registers are automatically set by the program. There is no need to display offset or control register values to the technician in some of these configurations, although their display can be made an option.

It will thus be appreciated that configurations of the present invention facilitate the calibration of computer numerically controlled machine tools. Such calibration advantageously permits a single CNC program to be used for a plurality of like machine tools to produce identically shaped and dimensioned parts without individual adjust of every such program to specifically accommodate the varying offsets of every machine tool.

While the invention has been described in terms of various specific embodiments, those skilled in the art will recognize that the invention can be practiced with modification within the spirit and scope of the claims.

What is claimed is:

1. A method for calibrating a CNC apparatus for controlling a machine tool, the CNC apparatus having a memory configured to compensate for offsets in a pivot point; the machine tool having a head, a pivot point, a spindle, a table, and at least four axes including an X-axis, a Y-axis, a Z-axis, and a C-axis, said method comprising:

placing an artifact of known height on the table;

placing a plug having a known diameter on the spindle;

touching the plug to the artifact in a plurality of orientations of the plug and in a plurality of locations of the plug and the artifact to determine uncalibrated X and Y pivot point locations at a plurality of orientations of the spindle; and utilizing the uncalibrated X and Y pivot point locations to determine and store values in the memory of the CNC apparatus to compensate for offsets in the pivot point.

2. A method in accordance with claim 1 wherein said touching the plug to the artifact in a plurality of orientations and in a plurality of locations of the plug and the artifact comprises:

touching a side of the plug to a side of the artifact at a C-axis angle of zero to determine an uncalibrated X pivot point location at C=0;

touching an end of the plug to a top of the artifact at a C-axis angle of zero to determine an uncalibrated Y pivot point location at C=0;

touching a side of the plug to the top of the artifact at a C-axis angle of 90 degrees to determine an uncalibrated Y pivot point location at C=90; and touching an end of the plug to a side of the artifact at a C-axis angle of 90 degrees to determine an uncalibrated X pivot point location at C=90.

3. A method in accordance with claim 2 wherein the artifact is magnetically affixed to the table.

4. A method in accordance with claim 2 wherein the machine tool is a grinding machine.

5. A method in accordance with claim 2 wherein the plug is cylindrical.

6. A method in accordance with claim 2 further comprising manually reading the uncalibrated X and Y pivot point locations from a control display and manually entering the uncalibrated X and Y pivot point locations into a spreadsheet program.

7. A method in accordance with claim 6 further comprising manually reading offset numbers determined and displayed by the spreadsheet program and manually entering the offset numbers into a register of a CNC apparatus.

8. A method in accordance with claim 6, wherein offsets are determined as:

$$SCLPP=((X2-X5+(BD/2))-(Y3-Y4+(BD/2)))/2, \text{ and}$$

$$GLPP=((X2-X5+(BD/2))+(Y3-Y4+(BD/2)))/2-(Y3-JBH);$$

where:

SCLPP=a spindle centerline to pivot point distance;

X2=a value of an X location read from the control output when touching the plug to the side of the artifact at C=0;

X5↑a value of an X location read from the control output when touching the plug to the side of the artifact at C=90;

Y3=a value of a Y location read from the control output when touching the plug to the top of the artifact at C=0 degrees;

Y4=a value of a Y location read from the control output when touching the plug to the top of the artifact at C=90 degrees;

GLPP=a gage line to pivot point dimension; and

JBH=the height of the artifact.

9. A method in accordance with claim 2 and in which said touching is performed in the order recited therein.

10. A method in accordance with claim 2 wherein the machine tool is a milling machine.

11. A method in accordance with claim 1 wherein the artifact is an angle plate having precisely perpendicular sides.

12. A method in accordance with claim 1 wherein said utilizing the uncalibrated X and Y pivot point locations to determine and store values in a memory of the CNC apparatus to compensate for offsets in the pivot point further comprises utilizing a CNC program to automatically rather than manually store and use the uncalibrated X and Y pivot point locations, and utilizing the program to automatically rather than manually store the values in the memory of the CNC apparatus to compensate for the offsets.

13. A computer-readable medium having recorded thereon machine readable instructions configured to instruct a computer to:

prompt a user to manually input uncalibrated X and Y pivot point locations at a plurality of orientations of a spindle of a computer numerically controlled (CNC) machine tool having a head, a pivot point, a spindle, a table, and at least four axes including an X-axis, a Y-axis, a Z-axis, and a C-axis; and utilize the uncalibrated X and Y pivot point locations to determine and display values of compensation data for entry in a memory of a CNC apparatus, wherein said compensation data is determined to compensate for offsets in a pivot point of the machine tool.

14. A computer readable medium in accordance with claim 13 further configured to determine offsets as:

$$SCLPP=((X2-X5+(BD/2))-(Y3-Y4+(BD/2)))/2, \text{ and}$$

$$GLPP=((X2-X5+(BD/2))+(Y3-Y4+(BD/2)))/2-(Y3-JBH);$$

where:

SCLPP=a spindle centerline to pivot point distance;

BD=a diameter of a plug placed on a spindle of the machine tool;

X2=a value of a manually input uncalibrated X pivot point location determined by touching the plug to a side of an artifact at C=0;

X5=a value of a manually input uncalibrated X pivot point location determined by touching the plug to the side of the artifact at C=90;

Y3=a value of a manually input uncalibrated Y pivot point location determined by touching the plug to a top of the artifact at C=0 degrees;

Y4=a value of a manually input uncalibrated Y pivot point location determined by touching the plug to the top of the artifact at C=90 degrees;

GLPP=a gage line to pivot point dimension; and

JBH=height of the artifact.

15. A computer readable medium in accordance with claim 14 further having instructions recorded therein configured to instruct the computer to utilize said offsets to determine said values of compensating data.

16. A kit comprising a computer readable medium in accordance with claim 13 and further comprising a plug having a known diameter and an artifact having a known height, wherein said known diameter and known height are hard-coded in said machine-readable instructions as said diameter of the plug placed on the spindle of the machine tool and said height of the artifact.

17. A computer numerical control (CNC) apparatus for a machine tool having a head, a pivot point, a spindle, a table, and at least four axes including an X-axis, a Y-axis, a Z-axis, and a C-axis, said CNC apparatus configured to:

prompt a user to place a plug on a spindle of the machine tool and an artifact on a table, and to prompt a user to orient the plug in a plurality of orientations and to touch the plug to the artifact in a plurality of locations, determine a plurality of uncalibrated X and Y pivot point locations from during said touching; and utilize the uncalibrated X and Y pivot point locations to determine and display values of compensation data to enter values in a memory of said CNC apparatus, wherein said compensation data is determined to compensate for offsets in a pivot point of the machine tool.

18. A CNC apparatus in accordance with claim 17 further configured to determine offsets as:

$$SCLPP=((X2-X5+(BD/2))-(Y3-Y4+(BD/2)))/2, \text{ and}$$

$$GLPP=((X2-X5+(BD/2))+(Y3-Y4+(BD/2)))/2-(Y3-JBH);$$

where:

SCLPP=a spindle centerline to pivot point distance;

BD=a diameter of a plug placed on a spindle of the machine tool;

X2=a value of a manually input uncalibrated X pivot point location determined by touching the plug to a side of an artifact at C=0;

X5↑a value of a manually input uncalibrated X pivot point location determined by touching the plug to the side of the artifact at C=90;

Y3=a value of a manually input uncalibrated Y pivot point location determined by touching the plug to a top of the artifact at C=0 degrees;

Y4=a value of a manually input uncalibrated Y pivot point location determined by touching the plug to the top of the artifact at C=90 degrees;

GLPP=a gage line to pivot point dimension; and

JBH=height of the artifact.

19. A CNC apparatus in accordance with claim 18 further configured to utilize said offsets to determine said compensation data.

20. A kit comprising a CNC apparatus in accordance with claim 17 and further comprising a plug having a known diameter and an artifact having a known height, wherein said known diameter and known height are hard-coded in a memory of said CNC apparatus as said diameter of the plug placed on the spindle of the machine tool and said height of the artifact.

* * * * *

UNITED STATES PATENT AND TRADEMARK OFFICE

CERTIFICATE OF CORRECTION

PATENT NO. : 7,090,561 B2 
APPLICATION NO. : 11/005986
DATED : August 15, 2006
INVENTOR(S) : Cambridge et al.

It is certified that error appears in the above-identified patent and that said Letters Patent is hereby corrected as shown below:

In Claim 8, column 9, line 50, delete "X5↑a value" and insert therefor -- *X*5=a value --.

In Claim 18, column 11, line 19, delete "X5↑a value" and insert therefor -- *X*5=a value --.

Signed and Sealed this

Thirteenth Day of November, 2007

JON W. DUDAS
*Director of the United States Patent and Trademark Office*